US011168962B2

(12) United States Patent
Bongiovanni et al.

(10) Patent No.: US 11,168,962 B2
(45) Date of Patent: Nov. 9, 2021

(54) SELF-SEALING LIQUID CONTAINMENT SYSTEM AND METHOD OF INSTALLING SAME

(75) Inventors: David Bongiovanni, Grand Island, NY (US); Michael Wiseman, Lancaster, PA (US); Adam Janicki, Hamburg, NY (US); Eric Forster, Nerville la forêt (FR)

(73) Assignee: HUTCHINSON S.A., Paris (FR)

( * ) Notice: Subject to any disclaimer, the term of this patent is extended or adjusted under 35 U.S.C. 154(b) by 46 days.

(21) Appl. No.: 13/479,528

(22) Filed: May 24, 2012

(65) Prior Publication Data

US 2012/0298660 A1 Nov. 29, 2012

Related U.S. Application Data

(60) Provisional application No. 61/490,832, filed on May 27, 2011.

(51) Int. Cl.

| | |
|---|---|
| ***F41H 5/04*** | (2006.01) |
| ***B65D 90/06*** | (2006.01) |
| ***B65D 90/22*** | (2006.01) |
| ***A62C 3/06*** | (2006.01) |

(52) U.S. Cl.

CPC ..... *F41H 5/0478* (2013.01); *B65D 90/06* (2013.01); *B65D 90/22* (2013.01); *A62C 3/065* (2013.01); *B65D 2590/245* (2013.01)

(58) Field of Classification Search

USPC ..... 220/560.01, 560.02, 9.1, 9.4

See application file for complete search history.

(56) References Cited

U.S. PATENT DOCUMENTS

| | | | | |
|---|---|---|---|---|
| 1,386,791 | A | 8/1921 | Murdock | |
| 1,406,478 | A | 2/1922 | Mote | |
| 2,407,515 | A | 9/1946 | Roberts | |
| 2,438,965 | A * | 4/1948 | Dasher | 442/260 |
| 2,601,525 | A * | 6/1952 | Howald et al. | 220/560.02 |
| 3,093,259 | A * | 6/1963 | Morrison | 220/592.25 |
| 3,509,016 | A * | 4/1970 | Wickersham, Jr. | B32B 27/00 220/560.02 |
| 3,587,914 | A | 6/1971 | Jennings et al. | |
| 3,698,587 | A * | 10/1972 | Baker et al. | 428/63 |
| 3,801,425 | A * | 4/1974 | Cook | 428/36.2 |
| 3,813,281 | A * | 5/1974 | Burgess et al. | 428/51 |

(Continued)

FOREIGN PATENT DOCUMENTS

| | | |
|---|---|---|
| EP | 0 184 760 A2 | 6/1986 |
| GB | 2 015 952 A | 9/1979 |

OTHER PUBLICATIONS

International Search Report and Written Opinion for corresponding International Application No. PCT/US2012/39265, dated Jul. 27, 2012.

(Continued)

*Primary Examiner* — Jeffrey R Allen
(74) *Attorney, Agent, or Firm* — K&L Gates LLP

(57) ABSTRACT

A system. The system includes one or more self-sealing panels and a cap member. The one or more self-sealing panels substantially cover an exterior surface of a liquid container. The cap member covers at least one of the following: one or more portions of the exterior surface of the liquid container; and an exterior surface of at least one of the one or more self-sealing panels.

7 Claims, 11 Drawing Sheets

(56) References Cited

U.S. PATENT DOCUMENTS

| | | | | |
|---|---|---|---|---|
| 3,830,261 | A * | 8/1974 | Hochberg et al. | 138/127 |
| 3,901,281 | A * | 8/1975 | Morrisey | 138/140 |
| 3,966,283 | A * | 6/1976 | Puterbaugh | 312/406 |
| 3,980,106 | A * | 9/1976 | Wiggins | 138/140 |
| 4,088,240 | A * | 5/1978 | San Miguel | 220/560.02 |
| 4,115,616 | A * | 9/1978 | Heitz et al. | 442/224 |
| 4,216,803 | A * | 8/1980 | Hall | 138/144 |
| 4,336,291 | A * | 6/1982 | Broadhurst et al. | 428/101 |
| 4,345,698 | A * | 8/1982 | Villemain | 220/560.02 |
| 4,368,086 | A * | 1/1983 | Villemain | 156/93 |
| 4,577,357 | A * | 3/1986 | Hall et al. | 5/686 |
| 4,765,512 | A | 8/1988 | Bull, Jr. | |
| 4,782,972 | A * | 11/1988 | Wenkman et al. | 220/4.28 |
| 4,925,057 | A * | 5/1990 | Childress et al. | 244/135 R |
| 5,383,567 | A * | 1/1995 | Sorathia et al. | 220/4.13 |
| 6,409,037 | B1 * | 6/2002 | Lin et al. | 220/4.34 |
| 6,446,824 | B1 | 9/2002 | Sluiter | |
| 6,586,080 | B1 * | 7/2003 | Heifetz | B29C 63/0017 428/198 |
| 6,991,124 | B1 * | 1/2006 | Palley et al. | 220/1.5 |
| 7,169,452 | B1 * | 1/2007 | Monk et al. | 428/35.7 |
| 7,185,778 | B1 * | 3/2007 | Palley et al. | 220/1.5 |
| 7,229,673 | B1 * | 6/2007 | Monk et al. | 427/407.1 |
| 7,381,287 | B2 * | 6/2008 | Monk et al. | 156/256 |
| 7,393,572 | B1 * | 7/2008 | Monk et al. | 428/35.7 |
| 7,571,828 | B2 * | 8/2009 | Palley et al. | 220/1.5 |
| 7,624,760 | B2 * | 12/2009 | Monk et al. | 138/99 |
| 7,900,333 | B2 * | 3/2011 | Tweet et al. | 29/428 |
| 8,043,676 | B2 * | 10/2011 | Ohnstad et al. | 428/35.7 |
| 2003/0114064 | A1 * | 6/2003 | Fu | B32B 5/26 442/239 |

OTHER PUBLICATIONS

International Preliminary Report on Patentability for corresponding International Application No. PCT/US2012/39265, dated Dec. 2, 2013.

Extended European Search Report dated Apr. 16, 2015 for corresponding European Patent Application No. 12793878.5.

* cited by examiner

SELF-SEALING LIQUID CONTAINMENT SYSTEM AND METHOD OF INSTALLING SAME

CROSS-REFERENCE TO RELATED APPLICATION

This application claims the benefit under 35 U.S.C. § 119(e) of the earlier filing date of U.S. Provisional Patent Application No. 61/490,832 filed on May 27, 2011.

BACKGROUND

This application discloses an invention which is related, generally and in various embodiments, to a self-sealing liquid containment system and a method of installing the same.

There are a variety of liquid containers currently in use which hold fuels (gasoline, jet fuel, kerosene, oil, diesel, etc.) or other fluid (water, alcohol, solvent, lubricant, etc.). Depending on the liquid which the containers are to hold, the containers may be fabricated from plastic, aluminum, steel, etc. For containers which are to hold fuel, such containers include, for example, free-standing fuel storage tanks, fuel tanks of vehicles, fuel transport vehicles, etc. In general, many of such fuel containers are constructed from metals (e.g., steel, aluminum, etc.) having nominal thicknesses and no special protection from a high impact event and/or a high energy ballistic event. A simplified representation of a liquid container capable of holding fuel is shown in FIG. 1.

In many situations, especially in military-related situations, a breach or opening created through the wall of a standard fuel container such as, for example, a fuel tank of a vehicle, can have disastrous consequences. Such consequences can range from the loss of valuable fuel to the ignition of the fuel and the explosion of the container/vehicle. In the case of a standard fuel container, if the standard fuel container is subjected to a high impact event and/or a high energy ballistic event, it is not uncommon for the event to cause a breach or opening through a wall of the fuel container. The breach or opening leads to the rapid loss of fuel, and possibly the ignition of the fuel and the explosion of the container/vehicle. Obviously, the breach or opening can pose a serious risk to the lives of people in the vicinity of the fuel container.

One approach to reducing the risk of the negative consequences associated with a breach or opening through a wall of the liquid container is to spray a protective coating over the exterior surface of the liquid container. Although the protective coating provides an increased level of protection for the liquid container, the protective coating is a less than optimal solution, especially for liquid containers utilized in a military setting. This approach is also relatively expensive due to the initial cost of the specialized equipment required to apply the spray, the special ventilation required to eliminate hazardous airborne particles associated with the spray process, the special personal protective equipment required to be used by the personnel operating the spray equipment, etc. Also, the specialized spray coating equipment includes a high number of components, and the ongoing maintenance costs associated with the high number of components are also relatively expensive. Adding to the cost and risk associated with this approach is the large amounts of dangerous materials which need to be stored and handled. Furthermore, the spray coating equipment tends to be large and bulky, tends to require a large footprint, is difficult to maneuver, and thus is not well-suited for use in the field. Finally, from a performance standpoint, the protective coating generally increases the weight of the liquid container by a substantial amount, and when the protective coating is subjected to a high impact event and/or a high energy ballistic event, the protective coating merely operates to minimize the size of the breach or opening therethrough—not to completely seal the breach or opening.

Another approach to reducing the risk of the negative consequences associated with a breach or opening through a wall of a liquid container is to surround the liquid container with ballistic plates. Although the ballistic plates provide an increased level of protection for the liquid container, the ballistic plates merely operate to prevent and/or minimize the occurrences of breaches or openings—not to self-seal and contain the liquid if a breach or opening does occur. Also, due to the fact that the ballistic panels are large, heavy and difficult to maneuver, the ballistic plates add a substantial amount of weight to the liquid container (and to any vehicle which includes the liquid container) and are relatively difficult to install. In some situations, the space requirements necessitated by the size of the ballistic panels are simply not available. Thus, this approach is also less than optimal.

BRIEF DESCRIPTION OF THE DRAWINGS

Various embodiments of the invention are described herein in by way of example in conjunction with the following figures, wherein like reference characters designate the same or similar elements.

DETAILED DESCRIPTION

It is to be understood that at least some of the figures and descriptions of the invention have been simplified to illustrate elements that are relevant for a clear understanding of the invention, while eliminating, for purposes of clarity, other elements that those of ordinary skill in the art will appreciate may also comprise a portion of the invention. However, because such elements are well known in the art, and because they do not facilitate a better understanding of the invention, a description of such elements is not provided herein.

Figure 1:
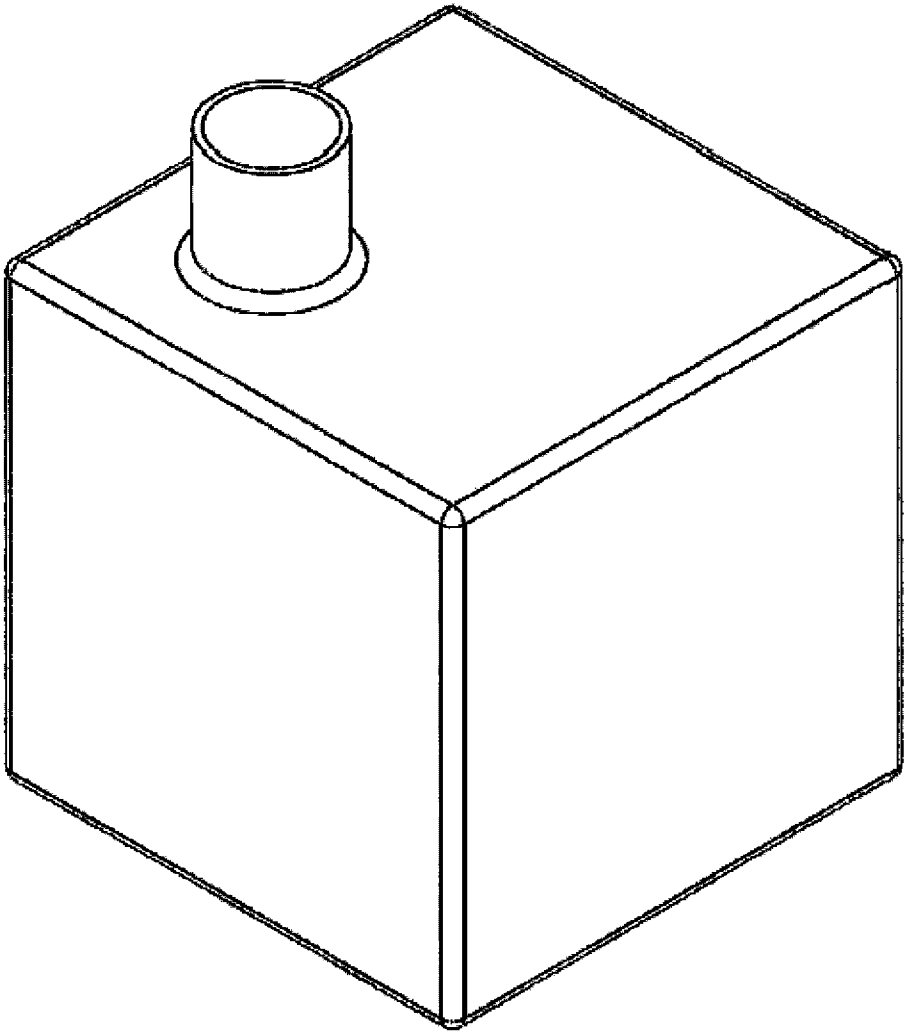
FIG. 1 (PRIOR ART)
FIG. 1 illustrates a simplified representation of a liquid container.
Figure 2:
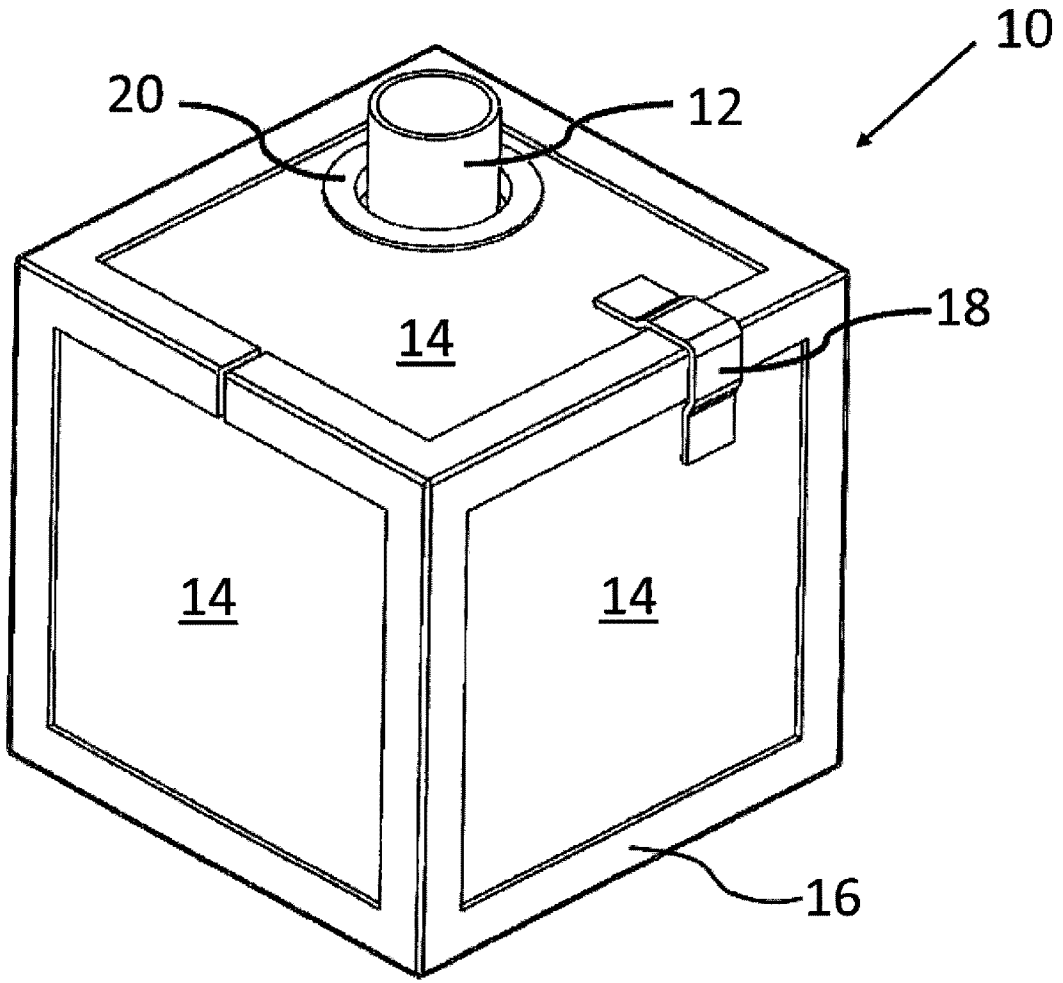
FIG. 2 illustrates various embodiments of a system.

FIG. 2 illustrates various embodiments of a system 10. The system 10 may be utilized to surround a liquid container 12 of any size, type and shape. The liquid held in the liquid container 12 may be a fuel (e.g., gasoline, jet fuel, kerosene, oil, diesel, etc.) or other fluid (water, alcohol, solvent, lubricant, etc.). The liquid container 12 may also form a portion of a larger apparatus such as a vehicle, an airplane, etc. For purposes of simplicity, the system 10 will be shown and described in the context of surrounding the liquid container of FIG. 1, with the liquid container 12 being embodied as a fuel tank of a vehicle. However, it will be appreciated that the liquid container 12 can be a liquid container other than a fuel tank. Because the system 10 surrounds the fuel tank 12, only a portion of the fuel tank 12 is shown in FIG. 2.

Once installed around the fuel tank 12, the system 10 operates as a self-sealing fuel containment system which automatically prevents fuel from escaping to the atmosphere when a high impact event and/or a high energy ballistic event causes a breach or opening to occur through a wall of the fuel tank. Such breaches or openings may occur, for example, when a projectile, shrapnel, etc. traveling at a high speed passes through at least a portion of the system 10, through a wall of the fuel tank 12, and into the interior of the fuel tank 12.

Figure 3:
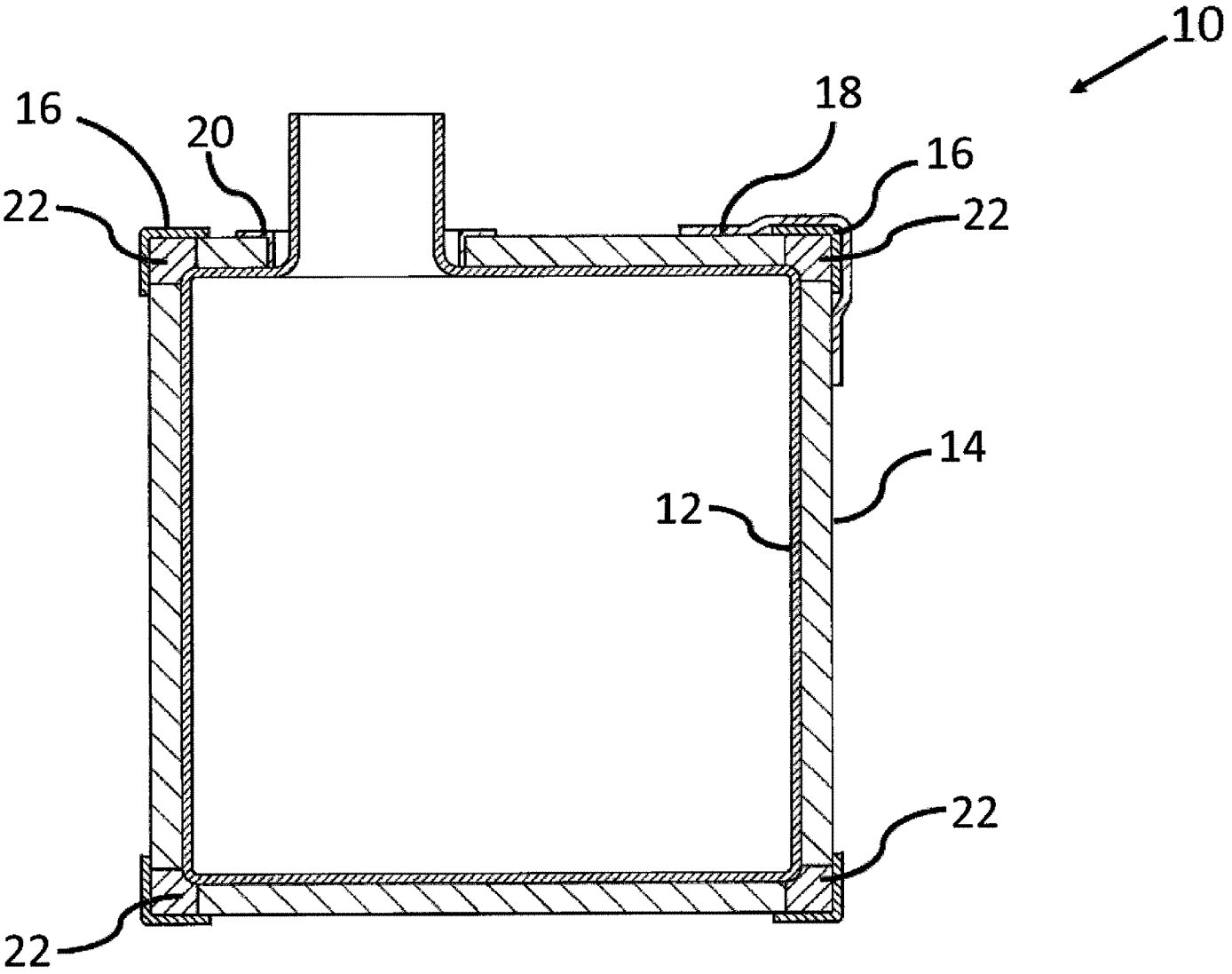
FIG. 3 illustrates a cross-section of the system of FIG. 2.

The system 10 includes one or more self-sealing panels 14 and a cap member 16. According to various embodiments, as described in more detail hereinbelow, the system 10 may also include a fastener 18, a grommet 20 and/or a filler material 22 (See FIG. 3). Although the system 10 is shown in FIG. 2 as a generally cube-shaped system, it will be appreciated that the system 10, once installed, may be of any suitable shape. It will also be appreciated that although only one self-sealing panel 14 is shown in FIG. 2 for a given "face" of the system 10, the system 10 may include any number of self-sealing panels 14 for a given "face".

Figure 4:
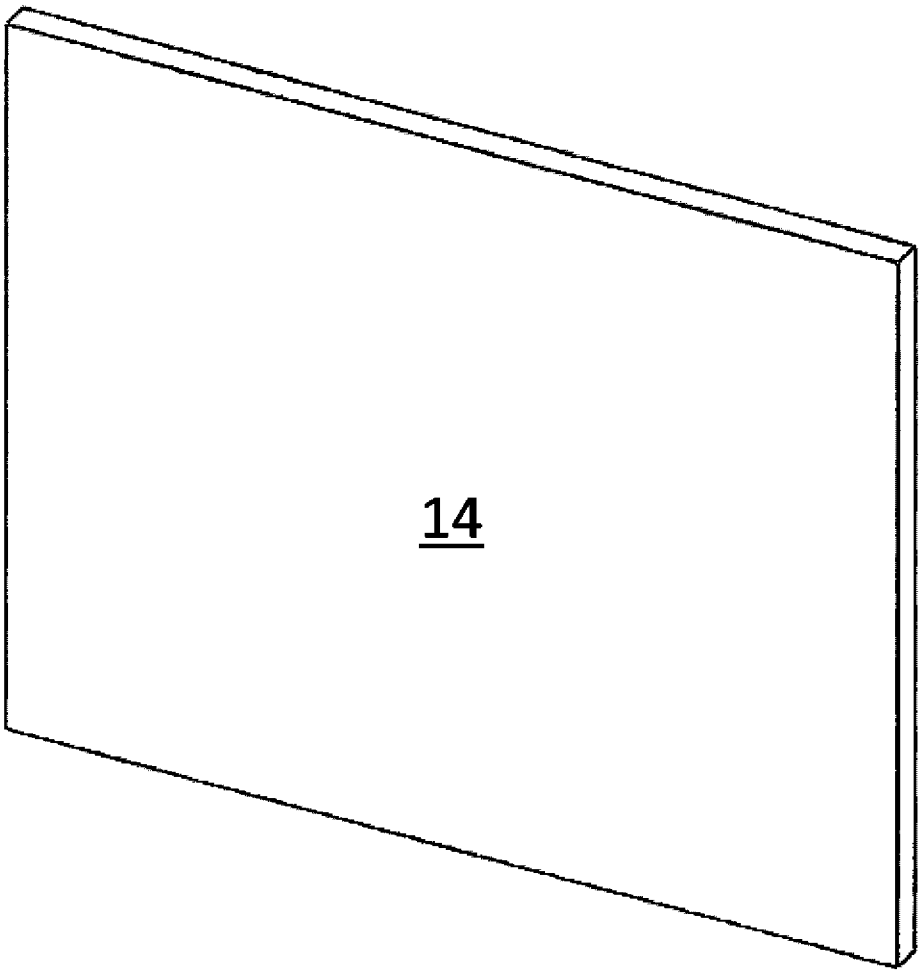
FIG. 4 illustrates various embodiments of a self-sealing panel of the system of FIG. 2.

FIG. 4 illustrates various embodiments of the self-sealing panel 14. In general, as described in more detail hereinbelow, the self-sealing panel 14 includes at least one self-sealing layer and at least one barrier layer, and may be utilized to cover the exterior surface of the fuel tank 12. According to various embodiments, the one or more self-sealing panels 14 are flexible self-sealing panels. Although the self-sealing panel 14 is shown in FIG. 4 as being rectangular shaped, it will be appreciated that the one or more self-sealing panels 14 may be of any suitable size and shape, including shapes having large contours and sweeping curves which correspond to the shapes of various fuel tanks having different configurations and geometries. According to various embodiments, one or more of the self-sealing panels 14 may be fabricated in a "flat" configuration, then subsequently wrapped around the external surface of a given fuel tank. According to other embodiments, the self-sealing panels 14 may be fabricated as "three-dimensional" self-sealing panels configured for fitting around corners, contours, etc. According to various embodiments, the overall thickness of the self-sealing panel 14 ranges from about 12 millimeters to about 18 millimeters.

Figure 5A:
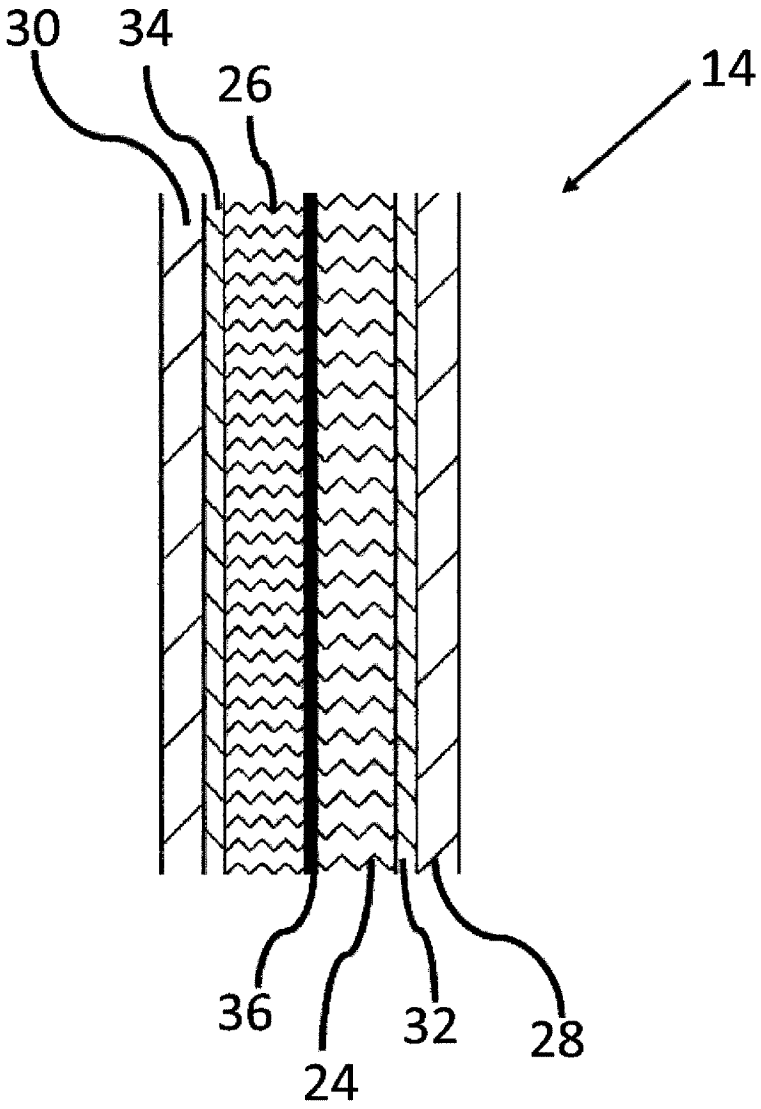
FIGS. 5A, 5B and 5C illustrate various embodiments of a cross-section of the self-sealing panel of FIG. 4.
Figure 5B:
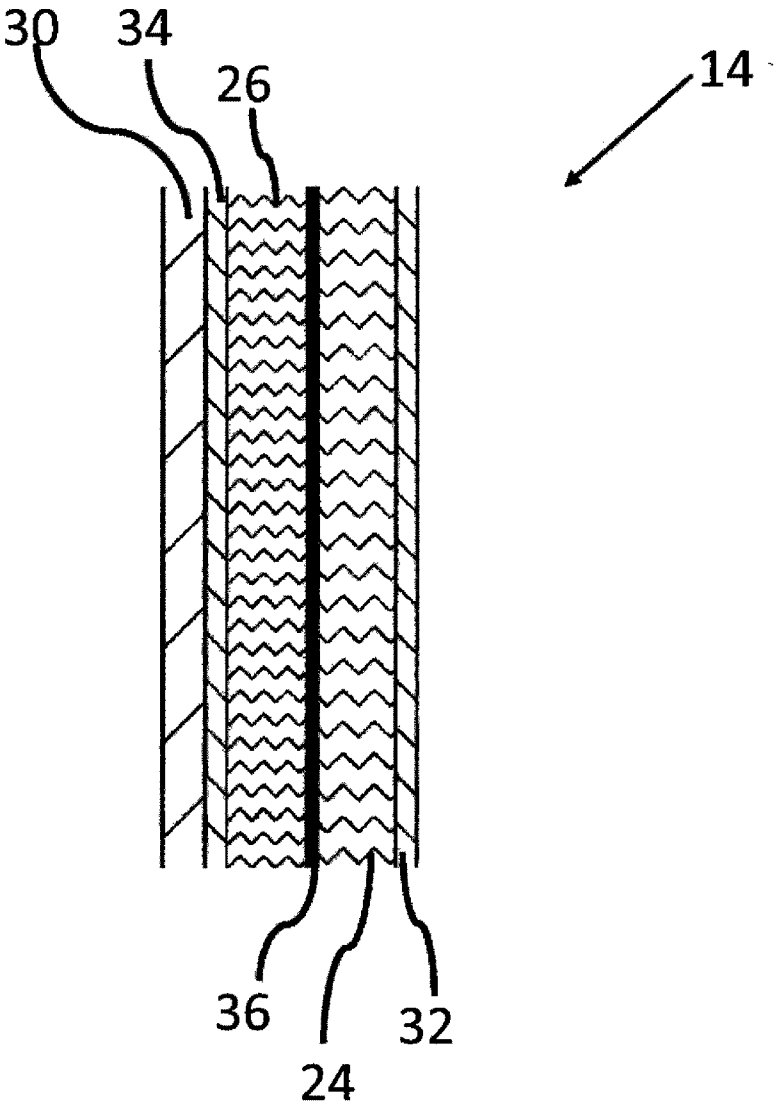
Figure 5C:
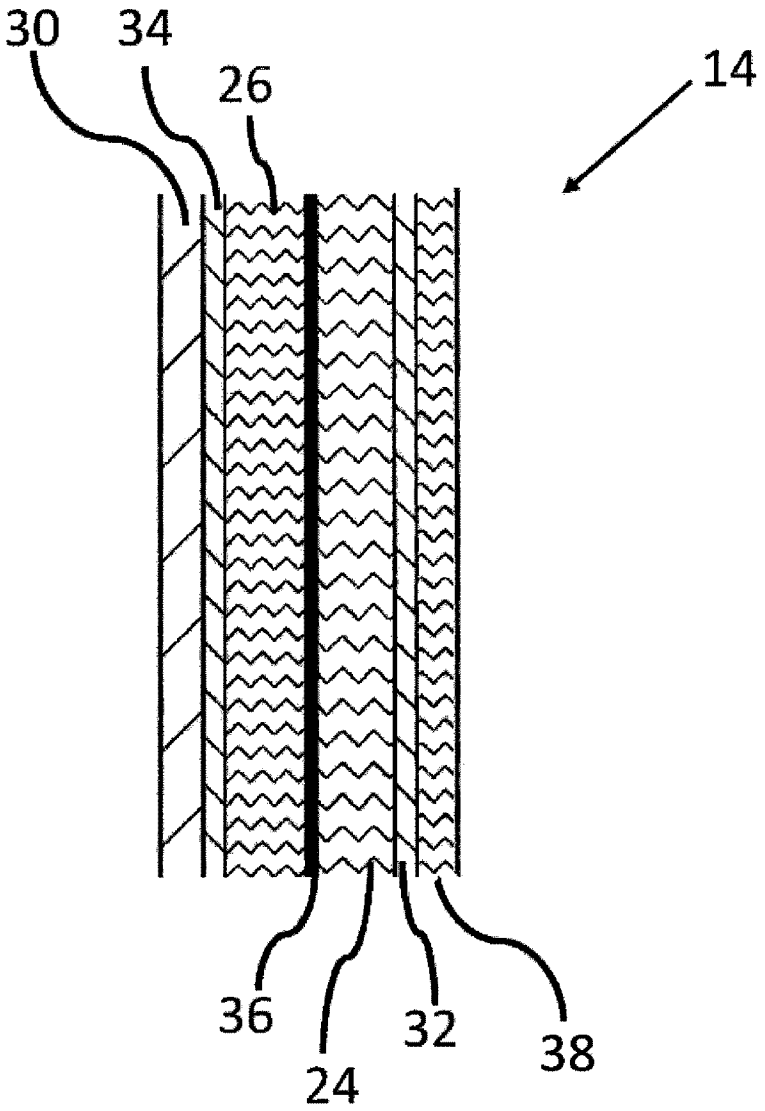

FIGS. 5A-5C illustrate various embodiments of a cross-section of the self-sealing panel 14. For the embodiments shown in FIG. 5A, the self-sealing panel 14 is a laminate structure which includes the following layers: a first self-sealing layer 24, a second self-sealing layer 26, a first barrier layer 28, a second barrier layer 30, a first fabric layer 32 and a second fabric layer 34. Although the first and second barrier layers 28, 30 are shown as separate layers in FIG. 5A, it will be appreciated that according to other embodiments, the first and/or second barrier layers 28, 30 may also extend around the perimeter "edges" of the self-sealing panel 14 and be in contact with one another, thereby forming a three-dimensional/encapsulated self-sealing panel 14. Alternatively, the self-sealing panel 14 may be encapsulated by covering the "edges" of the self-sealing panels 14 with other materials such as tape, sealant, combinations of tape and sealant, etc. According to various embodiments, at least one of the first and/or second fabric layers 32, 34 may be excluded from the embodiments shown in FIG. 5A. According to various embodiments, the self-sealing panel 14 also includes an adhesive material 36 between the first and second self-sealing layers 24, 26.

The first self-sealing layer 24 includes an elastomeric self-sealing material which rapidly expands in two and/or three dimensions either through chemical reaction or mechanical contraction if brought into contact with a fuel. The rapid expansion capability of the first self-sealing layer 24 contributes to the self-sealing functionality of the system 10. The elastomeric self-sealing material may be any suitable type of elastomeric self-sealing material which reduces or eliminates fuel leakage from the fuel tank after the occurrence of a high impact event and/or a high energy ballistic event. For example, according to various embodiments, the elastomeric self-sealing material may be a vulcanized rubber material, a highly elastic thermoplastic elastomer, a highly elastic thermoset elastomer, etc. According to various embodiments, the elastomeric self-sealing material is a vulcanized foam having a swelling potential of 400-600% and a weight ranging from 0.20-0.40 pounds per square foot. The first self-sealing layer 24 may be of any suitable thickness. For example, according to various embodiments, the thickness of the first self-sealing layer 24 is about 4 millimeters. The second self-sealing layer 26 may be similar or identical to the first self-sealing layer 24, and further contributes to the self-sealing functionality of the system 10.

For embodiments which include the adhesive material 36, the adhesive material 36 operates to adhere the first and second self-sealing layers 24, 26 to one another. The adhesive material 36 may be applied to the first and/or second self-sealing layers 24, 26 in any suitable arrangement. For example, according to various embodiments, the adhesive material 36 may be applied to cover less than the entire surface of the first and/or second self-sealing layers 24, 26. According to other embodiments, the adhesive material 36 may substantially cover the entire surface of the first and/or second self-sealing layers 24, 26 and thus may be considered to be an adhesive layer. The adhesive material 36 may be any suitable type of adhesive material. For example, according to various embodiments, the adhesive material 36 is a fuel-resistant nitrile-based adhesive material which permits localized separation between the first and second self-sealing layers 24, 26. The ability to localize separation between the first and second self-sealing layers 24, 26 provides the adhesive material 36 with the ability to allow increased localized swelling of the first and second self-sealing layers 24, 26 and to allow substantially uniform movement between the first and second self-sealing layers 24, 26 during a ballistic event. For example, if a projectile causes a void to be formed through the first and second self-sealing layers 24, 26, the adhesive material 36 allows the first and second self-sealing layers 24, 26 to reach maximum swell and fully fill the void.

The first barrier layer 28 includes a polymeric material and provides the system 10 with elevated strength and elasticity to minimize potential damage resulting from a high impact event and/or a high energy ballistic event. The polymeric material may be any suitable type of polymeric material. For example, according to various embodiments, the polymeric material is a polyurethane material having an elongation of 400-600% and a tensile strength ranging from 2300-2900 pounds per square inch. The first barrier layer 28 may be of any suitable thickness. For example, according to various embodiments, the thickness of the first barrier layer 28 ranges from about 3 millimeters to about 4 millimeters. In general, the high elasticity/elongation of the polymeric material in combination with the increased tensile strength of the polymeric material provides the polymeric material with the ability to reduce the net size of a breach or opening through the first barrier layer 28 resulting from such events and by extension, provides the first barrier layer 28 the ability to protect other components of the system 10.

The second barrier layer 30 provides additional protection to the other components of the system 10 and may also provide abrasion resistance and weather resistance to the system 10. According to various embodiments, the second barrier layer 30 may be identical or similar to the first barrier layer 28 (e.g., includes a polymeric material such as, for example, a polyurethane material). For embodiments which include the polymeric material, the polymeric material of the second barrier layer 30 may incur a weight loss of about 0.08 grams per 1000 cycles. According to various embodiments, the second barrier layer 28 may include a rubber material. The rubber material may be any suitable type of rubber material and may be of any suitable thickness. For example, according to various embodiments, the rubber material is a layer of polychloroprene rubber having a thickness of approximately 2.0 millimeters.

The first fabric layer 32 is positioned between the first self-sealing layer 24 and the first barrier layer 28. The first fabric layer 32 may include any suitable type of fabric material. For example, according to various embodiments, the first fabric layer 32 includes a high-strength (e.g., yarn modulus of about 14,000 ksi) fabric material made from ultra-high molecular weight polyethylene. The first fabric layer 32 may be of any suitable thickness. For example, according to various embodiments, the thickness of the first fabric layer 32 is about 0.5 millimeters. According to various embodiments, the first fabric layer 32 may be bonded directly to the first self-sealing layer 24, and such bonding may be realized in any suitable manner. For example, according to various embodiments, acrylic adhesives, rubber-based adhesives, polyurethane adhesives, direct vulcanization, etc. may be utilized to realize the bonding. According to various embodiments, the material of the first barrier layer 28 is pre-reacted on "top" of the first fabric layer 32. When the reaction of the material of the first barrier layer 28 is complete, an intimate mechanical and chemical bond is formed between the first fabric layer 32 and the first barrier layer 28. In combination with the first barrier layer 28, the first fabric layer 32 functions to "direct" any swelling of the first self-sealing layer 24 resulting from a high impact event and/or a high energy ballistic event to a localized area (e.g., at a breach or opening through the first self-sealing layer 24, the first fabric layer 32 and/or the first barrier layer 28) of the system 10.

The second fabric layer 34 is positioned between the second self-sealing layer 26 and the second barrier layer 28. According to various embodiments, the second fabric layer 34 is bonded directly to the second self-sealing layer 26 and is bonded to the second barrier layer 30 in the same manner that the first fabric layer 32 is bonded to the first barrier layer 28. The second fabric layer 34 may be identical or similar to the first fabric layer 32, and functions to "direct" any swelling of the second self-sealing layer 26 resulting from a high impact event and/or a high energy ballistic event to a localized area (e.g., at a breach or opening through the second self-sealing layer 26, the second fabric layer 34 and/or the second barrier layer 30) of the system 10.

For the embodiments shown in FIG. 5B, the self-sealing panel 14 is similar to the embodiments shown in FIG. 5A, but are different in that the first barrier layer 28 has been eliminated. According to various embodiments, at least one of the first and/or second fabric layers 32, 34 may be excluded from the embodiments shown in FIG. 5B.

For the embodiments shown in FIG. 5C, the self-sealing panel 14 is similar to the embodiments shown in FIG. 5A, but are different in that a third self-sealing layer 38 is utilized in lieu of the first barrier layer 28. For such embodiments, the third self-sealing layer 38 may include a foam material. The foam material may be any suitable type of foam material and may be of any suitable thickness. According to other embodiments, the third self-sealing layer 38 may be similar or identical to the first self-sealing layer 24 and/or the second self-sealing layer 26. According to various embodiments, at least one of the first and/or second fabric layers 32, 34 may be excluded from the embodiments shown in FIG. 5C. Additionally, it will be appreciated that according to other embodiments, the self-sealing panel 14 may include other combinations and/or arrangements of self-sealing layers, barrier layers and/or fabric layers than those shown in FIGS. 5A-5C.

According to various embodiments, the self-sealing panels 14 are compression fit directly to the exterior surface of the fuel tank 12. According to other embodiments, an adhesive material is utilized to connect the self-sealing panels 14 to the fuel tank. The adhesive material may be applied to the exterior surface of the fuel tank 12 and/or an exterior surface of the self-sealing panels 14 (e.g., the first barrier layer 28 of the self-sealing panel 14) prior to the installation of the self-sealing panels 14 to the fuel tank 12. The adhesive material may be applied to the exterior surface of the fuel tank 12 and/or a surface of the self-sealing panels 14 in any suitable arrangement. For example, according to various embodiments, the adhesive material may be applied to cover less than the entire exterior surface of the fuel tank 12 and/or the surface of the self-sealing panels 14. According to other embodiments, the adhesive material may substantially cover the entire exterior surface of the fuel tank 12 and/or a surface of the self-sealing panels 14 and thus may be considered to be an adhesive layer. The adhesive material may be any suitable type of adhesive. For example, according to various embodiments, the adhesive material may be a fuel resistant, fast cure two part polyurethane adhesive. Such an adhesive material may have an elongation greater than or equal to the respective elongations of the fuel tank 12 and the first barrier layer 28, and has a peel strength greater than 2 pounds per lineal inch. The adhesive material may also be applied to another exterior surface of the self-sealing panels 14 (e.g., the second barrier layer 30 of the self-sealing panel 12) and/or a surface of the cap member 16 prior to the installation of the cap member 16 to the self-sealing panels 14.

According to various embodiments, an adhesion promoter is utilized with the adhesive material to connect the self-sealing panels 14 to the fuel tank 12. The adhesion promoter may be applied to the exterior surface of a fuel tank 12 and/or a surface of the self-sealing panels 14 (e.g., the first bather layer 28 of the self-sealing panel 14) followed by the application of the adhesive material thereon prior to the installation of the self-sealing panels 14 to the fuel tank 12. The adhesion promoter may be any suitable type of adhesion promoter. For example, according to various embodiments, the adhesion promoter may be a two-part epoxy/polyurethane adhesion promoter. The resulting peel strength of the combination of the adhesion promoter and the adhesive material is greater than 2 pounds per lineal inch.

Figure 6:
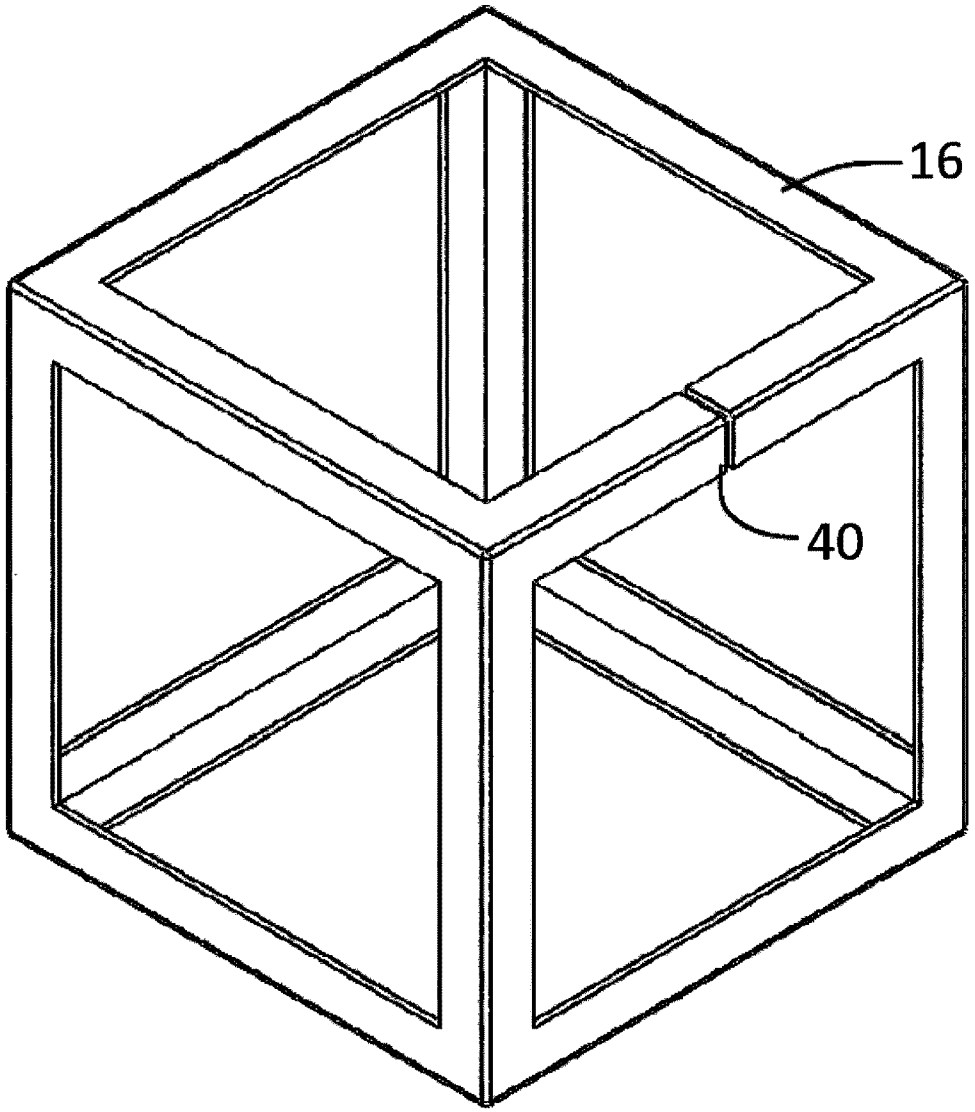
FIG. 6 illustrates various embodiments of a cap member of the system of FIG. 2.

FIG. 6 illustrates various embodiments of the cap member 16. The cap member 16, once installed over one or more of the self-sealing panels 14, covers one or more portions of the exterior surface of the fuel tank 12 which are not completely covered by the self-sealing panels 14. The cap member 16 may be connected to the respective self-sealing panels 14 in any suitable manner. For example, according to various embodiments, the cap member 16 is connected to the self-sealing panels 14 by an adhesive material (e.g., a polyurethane adhesive, a glue, etc.). According to other embodiments, the cap member 16 is connected to the self-sealing panels 14 by fasteners 18 such as, for example, bolts, snaps, clamps, etc. (See FIGS. 2 and 3). Although the cap member 16 is shown in FIG. 6 as a single-piece member having a single discontinuity or gap 40 along a portion thereof, it will be appreciated that according to other embodiments, the system 10 may include more than one cap member 16 and each cap member 16 may include more than one discontinuity or gap 40 along respective portions thereof. The discontinuity or gap 40 allows the cap member 16 to be "opened up" to more easily install the cap member 16 over portions of the self-sealing panels 14 covering the fuel tank 12. Thus, it will be appreciated that according to various embodiments, the cap member 16 is a flexible cap member 16. The cap member 16 may include any suitable type of material. For example, according to various embodiments, the cap member 16 includes a thermoplastic polymer, a thermoset polymer, a rubber, etc. According to various embodiments, the cap member 16 includes a highly elastic flame retardant material such as, for example, a rubber material (e.g., polychloroprene rubber), and has a thickness of approximately 1.0 millimeters. According to other embodiments, the cap member 16 may be self-sealing, and may include a laminate structure similar or identical to that of the self-sealing panels 14.

For the cube-shaped system 10 shown in FIG. 2, where the self-sealing panels 14 are shown in three different orthogonal planes, the cap member 16 forms both the "corners" and the "edges" of the cube-shaped structure. However, because the system 10 may be configured to surround a fuel tank 12 of any shape, configuration and geometry, including those having large contours and sweeping curves, it will be appreciated that in other implementations, the cap member 16 may be of a size and shape to cover "corners" and "edges" other than orthogonal corners and edges when installed over portions of the respective self-sealing panels 14.

Figure 7:
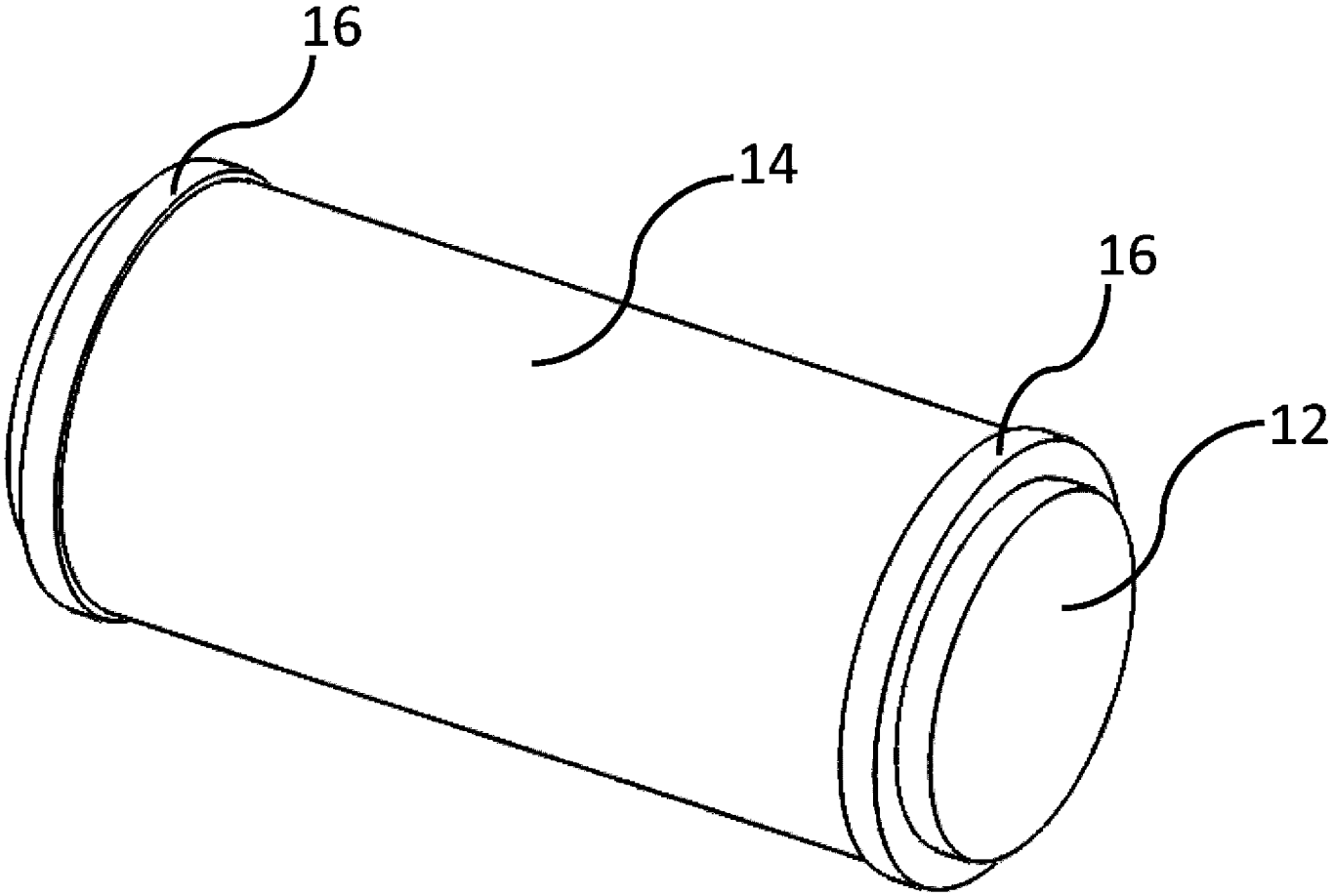
FIG. 7 illustrates other embodiments of a cap member.

For embodiments where the liquid container 12 is cylindrically-shaped, oval-shaped, etc., the cap member 16 may be embodied as a grommet similar to grommet 20 (See FIG. 7). For such embodiments, the cap member 16 may be embodied as a flame retardant rubber grommet, as a rigid grommet which includes a polymeric material such as, for example, a polyurethane, etc.

Figure 8:
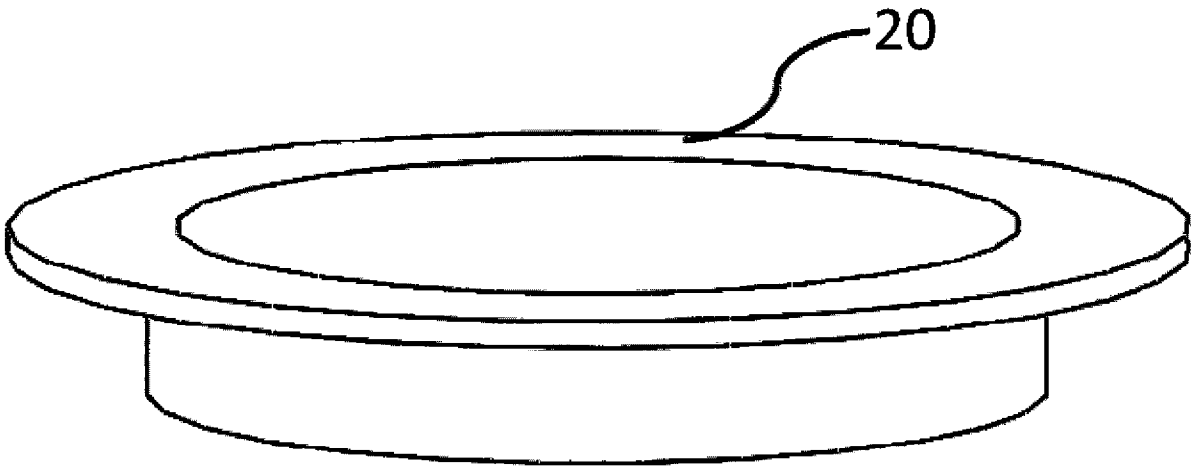
FIG. 8 illustrates various embodiments of a grommet of the system of FIG. 2.

FIG. 8 illustrates various embodiments of the grommet 20. For embodiments of the system 10 which include the grommet 20, various embodiments of one or more of the grommets 20 may be utilized to cover a space between the self-sealing panels 14 and a filler neck of the liquid container 12 (See FIGS. 2 and 3), a space between the self-sealing panels 14 and a vent hose connected to the liquid container 12, a space between the self-sealing panels 14 and a fuel outlet line connected to the liquid container 12, a space between adjacent self-sealing panels 14, a space between the cap member 16 and the liquid container 12, etc. As shown in FIG. 8, the grommet 20 may be continuous with no gaps or discontinuities.

For embodiments of the system 10 which include the filler material 22, the filler material 22 is positioned to fill gaps, voids or spaces between adjacent self-sealing panels 14 and/or between a fuel tank 12 and the cap member 16. For example, in certain applications, the self-sealing panels 14 may not cover the weld seams of a given fuel tank 12 (the weld seams are generally considered to be the weakest and most vulnerable area of the fuel tank). In such instances, for a given weld seam, a first self-sealing panel 14 covers the fuel tank 12 to the immediate "left" of the weld seam and a second self-sealing panel 14 covers the fuel tank 12 to the immediate "right" of the weld seam. The filler material 22 is positioned over the weld seam in a quantity sufficient to fill the space between the first and second self-sealing panels 14, and also serves as a reinforcing material which functions to reinforce/strengthen the area above the weld seam. According to other embodiments, flame retardant rubber grommets similar to grommet 20 are utilized in lieu of the filler material 22 to seal the space "above" the weld seam between the first self-sealing panel 14 and the second self-sealing panel 14.

Also, in certain applications, the self-sealing panels 14 do not completely overlap one another at the "corners" of the fuel tank 12. According to various embodiments, for such instances, the filler material 22 is positioned over the "corners" of the fuel tank 12 in a quantity sufficient to fill the space between the adjacent self-sealing panels 14 proximate the "corner" of the fuel tank 12 (See FIG. 3) and also serves as reinforcing material which functions to reinforce/strengthen the area proximate the "corner" of the fuel tank 12. According to other embodiments, flame retardant rubber grommets similar to grommet 20 are utilized in lieu of the filler material 22 to seal open "corners" of the fuel tank 12 and reinforce/strengthen the area proximate the "corners" of the fuel tank 12.

Furthermore, in certain applications, the self-sealing panels 14 do not completely overlap one another at the "edges" of the fuel tank 12. According to various embodiments, for such instances, the filler material 22 is positioned over the "edges" of the fuel tank 12 in a quantity sufficient to fill the space between adjacent self-sealing panels 14 proximate the "edge" of the fuel tank 12, and also serve as reinforcing material which function to reinforce/strengthen the area proximate the "edges" of the fuel tank 12. According to other embodiments, flame retardant rubber grommets similar to grommet 20 are utilized in lieu of the filler material 22 to seal any open "edges" of the fuel tank 12 and reinforce/strengthen the area proximate the "edges" of the fuel tank 12.

The filler material 22 may be any suitable type of material. For example, according to various embodiments, the filler material 22 is a self-leveling polyurethane material having an extremely fast cure. The filler material 22 may also be positioned over the fuel tank 12 and between adjacent self-sealing panels 14 in areas proximate a filler neck connected to the fuel tank 12, proximate a vent hose connected to the fuel tank 12, proximate a fuel outlet line connected to the fuel tank 12, etc. In general, the filler material 22 also functions as a hole-minimizing layer, thereby allowing for faster self-sealing by the system 10.

In view of the above, it will be appreciated that when the components of the system 10 are all installed over the fuel tank 12, the exterior of the fuel tank 12 is sealed from the atmosphere. It will also be appreciated that the system 10 is a durable, lightweight system which is unaffected by weathering and can be installed in the field (i.e., field mountable) without specialized equipment and without having to send the fuel tanks (and vehicles) offsite.

Figure 9:
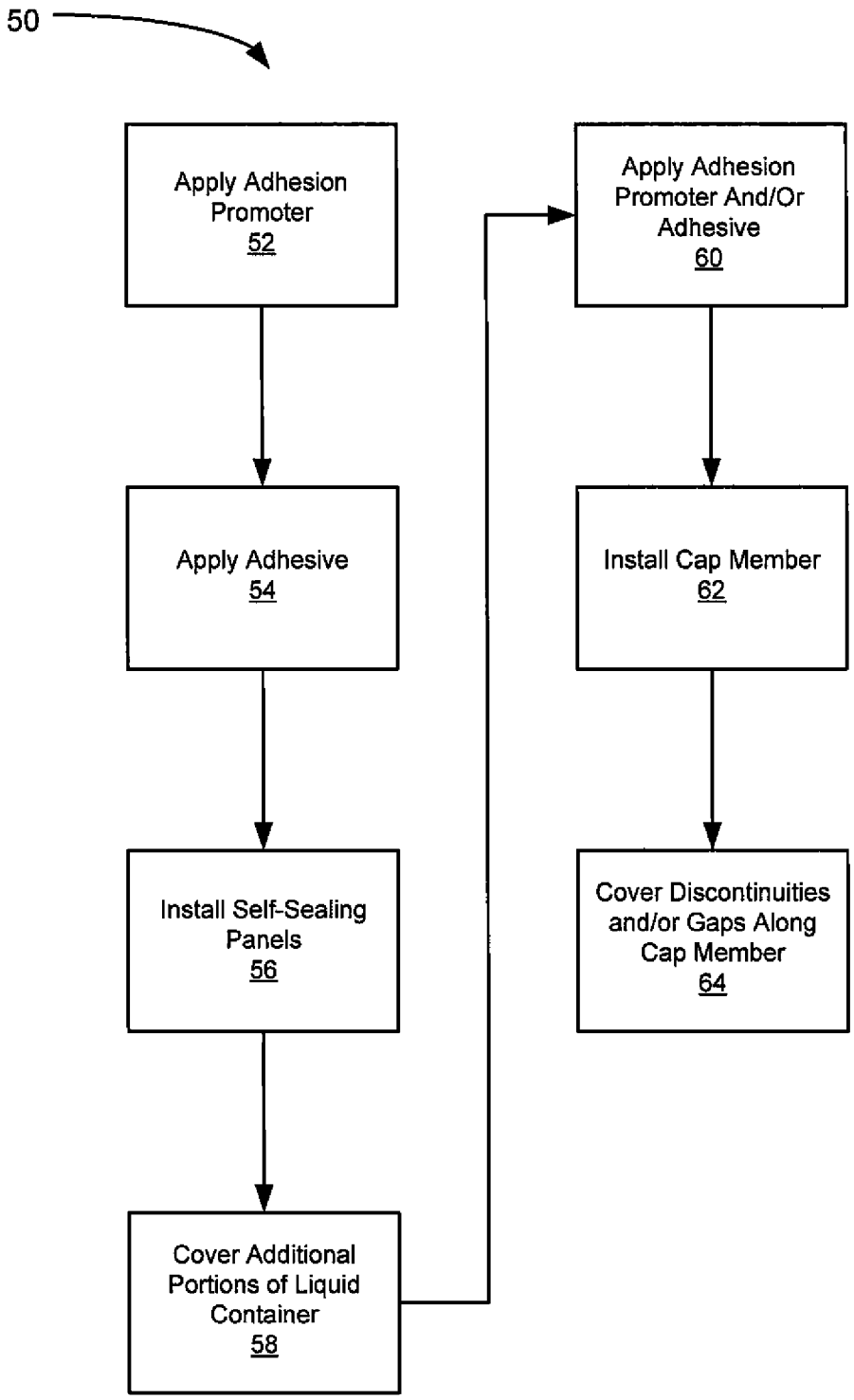
FIG. 9 illustrates various embodiments of a method.

FIG. 9 illustrates a method 50 of installing the system 10 of FIG. 1 according to various embodiments. Once installed and surrounding the fuel tank 12, the system 10 operates as a self-sealing fuel containment system which automatically prevents fuel from escaping to the atmosphere when a high impact event and/or a high energy ballistic event causes a breach or opening to occur through a wall of the fuel tank 12. For purposes of simplicity, the method 50 will be described for embodiments of the system 10 which include the self-sealing panel 14 of FIG. 5A.

The process starts at block 52, where an adhesion promoter is applied to cover a first surface of one of the self-sealing panels 14 and/or a portion of the fuel tank 12. The adhesion promoter may be applied in any suitable manner, including utilizing a mechanical dispensing gun, a powered dispensing gun, etc. to dispense the adhesion promoter onto the first surface of the sealing panel 14 (e.g., the first barrier layer 28) and/or fuel tank 12, then manually spreading the dispensed adhesion promoter over the first surface of the self-sealing panel 14 and/or the fuel tank 12. According to various embodiments, the adhesion promoter is applied to the first barrier layer 28 during the curing process of the polymeric material of the first barrier layer 28, thereby ensuring inseparable adhesion between the adhesion promoter and the first barrier layer 28.

From block 52, the process advances to block 54, where an adhesive material is applied over the adhesion promoter. As the adhesion promoter may be applied during the curing process of the polymeric material of the first barrier layer 28, it will be appreciated that steps 52 and 54 may be performed at different times and at different locations. The adhesive material may be applied in any suitable manner, including utilizing a mechanical dispensing gun, a powered dispensing gun, etc. to dispense the adhesive material onto the adhesion promoter, then manually spreading the dispensed adhesive material over the adhesion promoter.

From block 54, the process advances to block 56, where the self-sealing panel 14 is pressed against the fuel tank 12, thereby becoming adhered to the fuel tank. The process described at blocks 52-56 may be repeated any number of times until all of the self-sealing panels 14 for a given installation are adhered to the fuel tank 12. The self-sealing panels 14 may be adhered to the fuel tank 12 in horizontal planes or vertical planes, as well as in planes which are neither horizontal nor vertical. As described hereinabove, according to various embodiments, the adhesive material and the adhesion promoter are not utilized. For such embodiments, the process begins at step 56, where the one or more self-sealing panels 14 are compression fit directly to the fuel tank 12.

From block 56, the process advances to block 58, where at least a portion of the exterior surface of the fuel tank 12 not covered by the self-sealing panels 14 is covered. The uncovered portion of the exterior surface of the fuel tank 12 may be covered by the grommet 20 (e.g., between the self-sealing panels 14 and the filler neck connected to the fuel tank 10) and/or by the filler material 22 (e.g., at a "corner" of the fuel tank 10). The filler material 22 may be applied in any suitable manner, including a mechanical dispensing gun, a powered dispensing gun, etc. As described hereinabove, according to various embodiments, one or more flame retardant rubber grommets similar to grommet 20 may be utilized in lieu of the filler material 22 to cover any portions of the exterior surface of the fuel tank 10 which are not covered by the self-sealing panels 14.

From block 58, the process advances to block 60, where an adhesive material is applied to an "inside" surface of the cap member 16 and/or respective portions of self-sealing panels 14 (e.g., the second barrier layer 30 of the self-sealing panels 14). The adhesive material may be applied in any suitable manner, including utilizing a mechanical dispensing gun, a powered dispensing gun, etc. to apply the adhesive material to the "inside" surface of the cap member 16 and/or respective portions of the self-sealing panels 14, then manually spreading the adhesive material over the "inside" surface of the cap member 16 and/or the respective portions of the self-sealing panels 14. According to various embodiments, an adhesion promoter is applied to the "inside" surface of the cap member 16 and/or the respective portions of the self-sealing panels 14 prior to the application of the adhesive material.

From block 60, the process advances to block 62, where the cap member 16 is pressed against the self-sealing panels 14, thereby becoming adhered to the self-sealing panels 14. For embodiments where the system 10 includes more than one cap member 16, the process described at blocks 60 and 62 may be repeated any number of times until all of the cap members 16 for a given installation are adhered to the self sealing panels 14. As described hereinabove, according to various embodiments, the adhesive material and the adhesion promoter are not utilized. For such embodiments, the process advances from block 58 to block 62, where the cap member 16 (or cap members 16) are fastened to the self-sealing panels 14 by one or more fasteners 18 (e.g., bolts, snaps, clamps, etc.), etc.

From block 62, the process advances to block 64, where one or more discontinuities or gaps 40 along portions of the cap member 16 are covered. The uncovered discontinuities or gaps 40 may be covered by one or more grommets similar to the grommet 20 and/or by the filler material 22. For embodiments where the cap member 16 is continuous without any discontinuities or gaps 40 (e.g., when the fuel tank 10 is cylindrical-shaped or oval-shaped and the cap member 16 is embodied as a rigid grommet which includes a polymeric material), it will be appreciated that the actions associated with block 64 do not need to be performed and the process may end at block 62.

In view of the foregoing, it will be appreciated that the above-described method 50 may be carried out by personnel at any location, including remote field locations, without having to use specialized equipment and without having to send the fuel tanks (and vehicles) offsite.

The following list of reference numerals included in the drawing figures may be found to be of assistance in understanding more fully the concepts of the above-described invention:

10 System
12 Liquid Container
14 Self-Sealing Panel
16 Cap Member
18 Fastener
20 Grommet
22 Filler Material
24 First Self-Sealing Layer
26 Second Self-Sealing Layer
28 First Barrier Layer
30 Second Barrier Layer
32 First Fabric Layer
34 Second Fabric Layer
36 Adhesive Material
38 Third Self-Sealing Layer
40 Discontinuity or Gap Nothing in the above description is meant to limit the invention to any specific materials, geometry, or orientation of elements. Many part/orientation substitutions are contemplated within the scope of the invention and will be apparent to those skilled in the art. The embodiments described herein were presented by way of example only and should not be used to limit the scope of the invention.

Although the invention has been described in terms of particular embodiments in this application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. A system, comprising:

a liquid container, wherein the liquid container comprises a metal material;

a plurality of discrete, pre-fabricated, multi-layer self-sealing panels connected to the liquid container, wherein the plurality of discrete, multi-layer self-sealing panels are field mountable to and substantially cover an exterior surface of the liquid container, and wherein at least one of the plurality of discrete, pre-fabricated, multi-layer self-sealing panels comprises:

a first self-sealing layer comprising an elastomeric self-sealing material;

a first barrier layer portion comprising a polyurethane material, wherein the first barrier layer is connected to the liquid container;

a first fabric layer between the first self-sealing layer and the first barrier layer portion, wherein the first fabric layer comprises an ultra-high molecular weight polyethylene material;

a second barrier layer portion;

a second self-sealing layer between the second barrier layer portion and the first self-sealing layer; and a second fabric layer between the second barrier layer portion and the second self-sealing layer; and a self-sealing cap member connected to at least two of the plurality of discrete, multi-layer self-sealing panels, wherein the self-sealing cap member covers at least one of the following:

one or more portions of the exterior surface of the liquid container; and an exterior surface of each of the at least two of the plurality of discrete, multi-layer self-sealing panels.

2. A system, comprising:

a liquid container, wherein the liquid container comprises a metal material;

a plurality of discrete, pre-fabricated, multi-layer self-sealing panels connected to the liquid container, wherein the plurality of discrete, multi-layer self-sealing panels are field mountable to and substantially cover an exterior surface of the liquid container, and wherein at least one of the plurality of discrete, pre-fabricated, multi-layer self-sealing panels comprises:

a first self-sealing layer comprising an elastomeric self-sealing material;

a first barrier layer portion comprising a polyurethane material, wherein the first barrier layer is connected to the liquid container;

a first fabric layer between the first self-sealing layer and the first barrier layer portion, wherein the first fabric layer comprises an ultra-high molecular weight polyethylene material;

a second barrier layer portion;

a second self-sealing layer between the second barrier layer portion and the first self-sealing layer; and a second fabric layer between the second barrier layer portion and the second self-sealing layer; and a cap member connected to at least two of the plurality of discrete, multi-layer self-sealing panels, wherein the cap member comprises a laminate structure comprising a barrier layer and a self-sealing layer, and covers at least one of the following:

one or more portions of the exterior surface of the liquid container; and an exterior surface of each of the at least two of the plurality of discrete, multi-layer self-sealing panels.

3. The system of claim 2, wherein the laminate structure further comprises a second self-sealing layer positioned between the barrier layer and the self-sealing layer.

4. The system of claim 3, wherein the laminate structure further comprises an adhesive material positioned between the self-sealing layer and the second self-sealing layer.

5. The system of claim 2, wherein the laminate structure further comprises a fabric layer positioned between the self-sealing layer and the barrier layer.

6. The system of claim 2, wherein the laminate structure further comprises a second barrier layer, wherein the self-sealing layer is positioned between the barrier layer and the second barrier layer.

7. The system of claim 6, wherein the laminate structure further comprises a fabric layer positioned between the second barrier layer and the self-sealing layer.

* * * * *